US005315077A

United States Patent [19]

Simon et al.

[11] Patent Number: 5,315,077

[45] Date of Patent: May 24, 1994

[54] ROTARY SWITCH INCLUDING CAM OPERATED FLEXIBLE CONTACTS

[75] Inventors: Thomas E. Simon, Corona; Thanh Nguyen, Pomona; Paul Gratzinger, Moreno Valley, all of Calif.

[73] Assignee: Bourns, Inc., Riverside, Calif.

[21] Appl. No.: 42,970

[22] Filed: Apr. 5, 1993

[51] Int. Cl.[5] ..... H01H 19/60; H01H 21/80

[52] U.S. Cl. ..... 200/11 R; 200/6 B; 200/6 BB; 200/569

[58] Field of Search ..... 200/6 R, 6 B, 6 BB, 200/11 R, 11 TW, 564, 565, 568, 569; H01H 19/60, 21/80

[56] References Cited

U.S. PATENT DOCUMENTS

| | | | |
|---|---|---|---|
| 3,594,527 | 7/1971 | Brant et al. | 200/11 G |
| 3,819,886 | 6/1974 | Homan et al. | 200/38 B |
| 4,012,606 | 3/1977 | Hutt | 200/18 |
| 4,135,065 | 1/1979 | Nicot | 200/11 DA |
| 4,163,879 | 8/1979 | Mayer et al. | 200/11 TW |
| 4,267,412 | 5/1981 | Janssen et al. | 200/6 B |
| 4,400,597 | 8/1983 | Bruder et al. | 200/6 B |
| 4,578,547 | 3/1986 | Gunther et al. | 200/11 DA |
| 4,599,605 | 7/1986 | Froeb et al. | 341/16 |
| 4,728,755 | 3/1988 | Fowler et al. | 200/11 DA |
| 4,822,960 | 4/1989 | Assum et al. | 200/11 R |
| 4,894,500 | 1/1990 | Yamazaki et al. | 200/565 |
| 4,922,063 | 5/1990 | Shimizu et al. | 200/11 R |
| 5,008,498 | 4/1991 | Yamazaki | 200/11 R |
| 5,010,214 | 4/1991 | Yamazaki | 200/6 B |
| 5,027,021 | 6/1991 | Tsuchida | 310/68 A |

OTHER PUBLICATIONS

Mepcopal Brochures for Model S-7000, S-5000, S-8000 Rotary Coded Switches, no date.

C & K Components, Inc. Brochure for 3D Series DIP Coded Rotary Switches, no date.

AMP, Inc. Brochure for 3100 Series Multi-Layer Rotary Switches, no date.

*Primary Examiner*—J. R. Scott

*Attorney, Agent, or Firm*—Klein & Szekeres

[57] ABSTRACT

A rotary switch includes a plurality of switching terminals exposed within a chamber in a housing. A fixed planar contact member, having a plurality of spring contact arms, is mounted in the chamber above the terminals. Each of the contact arms is movable out of the plane of the contact member to contact an associated one of the terminals. Each of the contact arms includes a cam follower, at least two of the cam followers being equidistant from the center of the contact member. The cam followers are operatively engaged, in a predetermined sequence, by camming elements extending axially from the bottom surface of a rotor mounted in the chamber above the contact member. The equidistant cam followers are engaged by camming elements that are spaced from the center of the rotor by a distance equal to the distance separating the equidistant cam followers from the center of the contact member. Thus, at least two contact arms are actuated by camming elements sharing a common radius, thereby allowing the optimum use of space. The contact member is fixed in the chamber by a set of asymmetrical tabs that are received in slots in the chamber wall, thereby preventing an inadvertent erroneous orientation of the contact member during assembly.

21 Claims, 4 Drawing Sheets

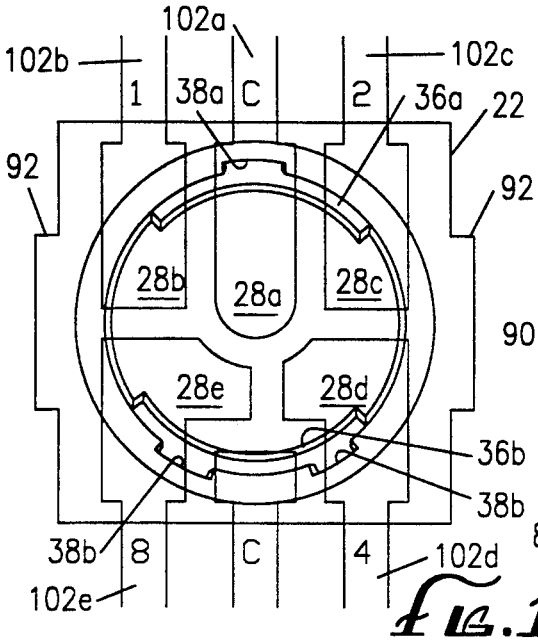
FIG. 10
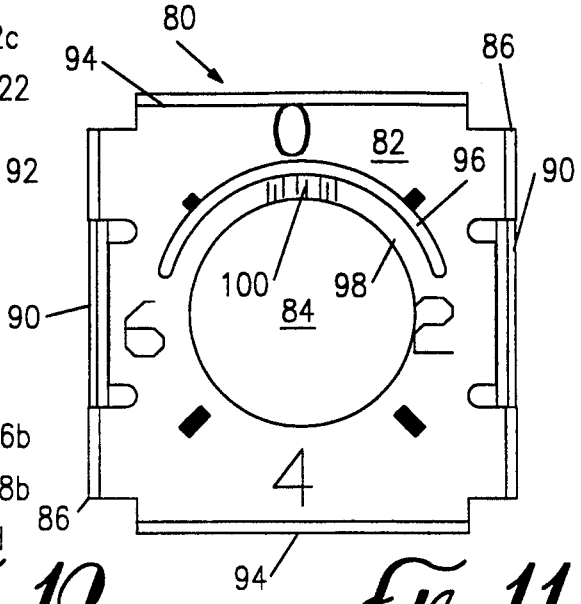
FIG. 11
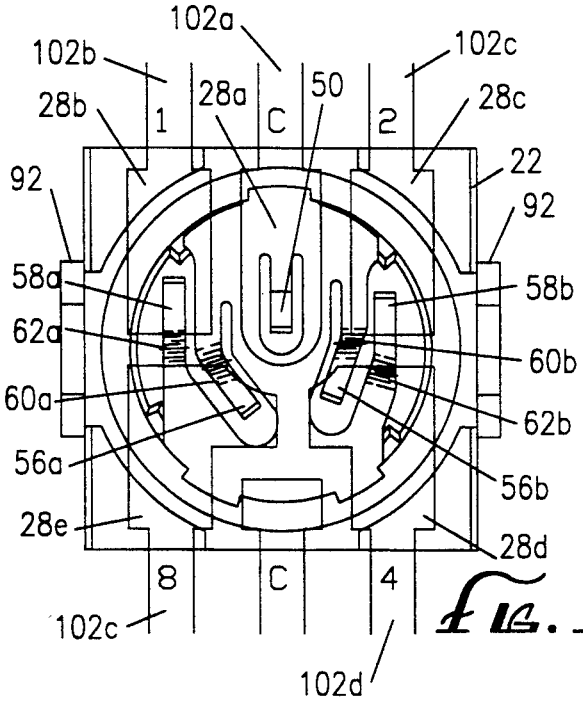
FIG. 12
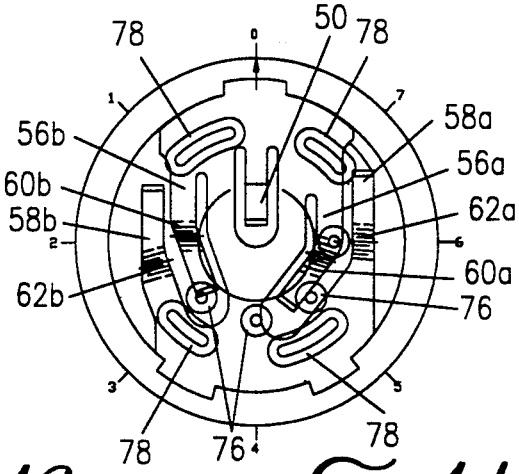
FIG. 14a
8 POSITION
| | 1 | 2 | 4 | C |
|---|---|---|---|---|
| 0 | | | | X |
| 1 | X | | | X |
| 2 | | X | | X |
| 3 | X | X | | X |
| 4 | | | X | X |
| 5 | X | | X | X |
| 6 | | X | X | X |
| 7 | X | X | X | X |
FIG. 13
10 POSITION
| | 1 | 2 | 4 | 8 | C |
|---|---|---|---|---|---|
| 0 | | | | | X |
| 1 | X | | | | X |
| 2 | | X | | | X |
| 3 | X | X | | | X |
| 4 | | | X | | X |
| 5 | X | | X | | X |
| 6 | | X | X | | X |
| 7 | X | X | X | | X |
| 8 | | | | X | X |
| 9 | X | | | X | X |
FIG. 17

ROTARY SWITCH INCLUDING CAM OPERATED FLEXIBLE CONTACTS

BACKGROUND OF THE INVENTION

This invention relates generally to the field of rotary switches. More specifically, it relates to a rotary encoding switch, of the type having a stationary contact spring element with multiple spring contact fingers that are urged axially into engagement with selected coded terminal elements by an arrangement of axial cams on the underside of a rotor.

Rotary encoding switches, of the type mentioned above, are known in the art. See, for example, U.S. Pat. No. 4,400,597—Bruder et al.; U.S. Pat. No. 5,008,498—Yamazaki; and U.S. Pat. No. 5,010,214—Yamazaki. In such switches, a stationary spring contact, or "spider", having multiple spring contact arms, is fixed within a housing between a rotor and a plurality of fixed coded electrical terminals, so that the spring arms are axially movable to make and break electrical contact with the terminals. A rotor is provided with a plurality of axially-extending camming elements on the surface facing the spider. As the rotor is turned, the camming elements are brought into and out of engagement with cam follower structures on each of the contact arms, whereby the arms are displaced axially into contact with a selected terminal as the rotor is turned, in accordance with the pattern of the camming elements. When the cam follower structure on an arm is not engaged by a cam, the resilience of the arm causes it to move axially out of engagement with the terminal, thereby breaking contact therewith.

There has been a long term trend for higher degrees of miniaturization of electronic components. Consistent with that trend, components such as rotary switches have been substantially reduced in size, and further size reductions are still demanded. For example, surface mounted components, including rotary switches, are now commonly made smaller than 10 mm on a side, and components of as little as 4 to 5 mm on a side are in increasing demand.

The structure of the prior art rotary switches, of the type described above, makes such ultra-miniaturization difficult to achieve while maintaining performance criteria, such as accuracy and reliability. For example, the device described in the above-referenced patent to Bruder et al. employs a spider having radial contact arms of substantially uniform total length, each having a single cam follower tab. Each of the tabs is located at a different unique radius, for actuation by a cam lobe located at the corresponding radius on the facing surface of the rotor. Electrical contact between the contact arms and the switching terminals occurs at the ends of the contact arms. This radial contact arm structure, and the need to have one contact arm dedicated to each camming radius, lead to an inefficient use of space that imposes limits on the degree of miniaturization that can be achieved.

A more efficient use of space is obtained in the devices described in the above-referenced patents to Yamazaki. These devices employ a stationary contact or spider having the configuration shown in FIG. 1 attached to the present specification. As shown, the prior art spider 10 includes a plurality of contact arms 12*a*, 12*b*, 12*c*, 12*d*, and 12*e*, arranged circumferentially, rather than radially. Each contact arm 12*a*—12*e* is located at a different radial distance from the center of the spider, and is actuated by a rotor-mounted camming element (not shown) that is located at the same radial distance from the center of the rotor, and that operates on its associated contact arm through a cam follower projection 14 on the arm.

In other words, each camming element, at its unique distance from the center of the rotor, operates on a single contact arm located at the same radial distance from the center of the spider. In a binary coded switch, each binary bit (i. e., 1, 2, 4, 8, etc.), is defined by a unique camming element operating only on its associated contact arm. Thus, each bit requires its own unique operational camming element/contact arm radius, thereby requiring either spiders and rotors of larger radii, or smaller (and more delicate) contact arms and camming elements, as the number of bits is increased. In addition, for any given number of bits, size can be reduced only by reducing the width of the contact arms and reducing the size and spacing between the camming elements, thereby possibly compromising durability and reliability.

In short, if further miniaturization is desired, one must either reduce the width of each contact arm, or limit the number of contact arms. If the former course action is employed, durability and reliability may be compromised, and manufacturing costs may be increased. If the latter strategy is used, the number of switching values may be limited.

It would therefore be desirable, if maximum efficiency in space utilization is the goal (as it is in ultra-miniaturization), to arrange the contact arms and the associated camming structures so that more than one contact arm is located at a single radial distance from the center of the spider, so as to be actuated by one or more camming structures located at that same radial distance from the center of the rotor.

SUMMARY OF THE INVENTION

The present invention is a multi-position rotary switch having a stationary conductive contact member, or "spider", with multiple spring contact arms, that is fixed in a housing between a rotor and a plurality of fixed coded electrical switching terminals. The spider is fixed in place in the housing at first and second end portions. The preferred embodiment has an inner pair of contact arms and an outer pair of contact arms, arranged symmetrically with respect to a common or ground contact finger at the center of the spider. The inner contact arms extend in a first direction from the first end portion toward the second end portion, while the outer contact arms extend in a second direction from the second end portion toward the first end portion. Each of the contact arms has a cam follower protuberance, thereby providing inner and outer pairs of cam followers. The cam followers on the inner arms are equidistantly spaced, at a first radial distance, from the center of the spider on opposite sides thereof, while the cam followers on the outer arms are equidistantly spaced, at a second radial distance greater than the first radial distance, from the center of the spider on opposite sides thereof. Thus, at each of the first and second radial distances from the center, there are two cam followers. The cam followers at each of the first and second radial distances are operatively engaged by one or more camming elements on the facing surface of the rotor, which are at the corresponding radial distance from the center of the rotor.

As the rotor is rotated to selected rotational positions, each of which corresponds to a numerical value, the cam follower protuberances at each radial distance from the center are operatively engaged by each of the camming elements at that same radial distance, in accordance with a preselected sequence dictated by the arrangement of the camming elements and the cam follower protuberances. The engagement of a protuberance by a camming element results in the actuation of the contact arm on which the protuberance is located, by means of the bending of the contact arm axially out of the plane of the spider. Each contact arm represents a unique binary bit, and, when actuated by a camming element, is brought into electrical contact with one of the coded switching terminals, producing an output signal representing that bit. The contact arms and camming elements are arranged so that a 360° rotation of the rotor yields the sequential actuation of the contact arms in combinations that produce binary coded signals representing all the integral numerical values within a range determined by the number and arrangement of the camming elements.

For example, in a preferred embodiment of the invention, there are four contact arms, one for each binary bit from "1" to "8", arranged symmetrically, as described above, around a center "common"contact. A first pair of contact arms, representing the "4" and "8" bits, respectively, are located on opposite sides of the center, with their cam followers at a first radial distance from the center. The contact arms in the first pair extend in a first direction, and respectively make electrical contact with terminals representing the numerical output values of "4" and "8" when actuated (that is, axially displaced) by a first set of camming elements located at the same radial distance from the center of the rotor. A second pair of contact arms, representing the "1" and "2" bits, respectively, are located on opposite sides of the center, with their cam followers at a second radial distance from the center, which is greater than the first radial distance. The contact arms in the second pair extend in a second direction, and respectively make electrical contact with terminals representing the numerical output values "1" and "2" when actuated by a second set of camming elements radially separated from the first set of camming elements by a radial distance equal to the radial separation between the inner and outer pairs of cam followers. With this arrangement, up to 10 binary coded numerical output values can easily be obtained, depending on the number and arrangement of the camming elements in each set. Greater numbers of numerical output values can be obtained with relatively minor modifications in the contact arm and camming element arrangements.

With the arrangement of more than one contact arm, each representing a different binary bit value, actuated (by means of its camming protuberance) at a given radial distance from the center of the stationary contact element or spider, optimum usage of space is achieved. As a result, a very high degree of miniaturization can be obtained, without sacrificing durability or reliability. For example, a binary coded switch having as many as 10 (and possibly more) numerical output values can be provided in a housing as small as 4 to 6 mm on a side, with contact arms and camming elements that are of substantial enough construction to endure relatively long term use, undergoing a large number of rotational cycles without significant loss of structural integrity.

The rotor is retained in the housing by a retention casing that is secured to the sides of the housing, and that has a central aperture in its top surface through which the central portion of the top of the rotor is exposed. The top surface of the rotor is provided with a plurality of radial detent grooves that extend toward the peripheral edge of the rotor. A resilient detent member is located on the retention casing so as to engage the detent grooves sequentially as the rotor is rotated, thereby providing a detented position for each numerical output value.

The advantages mentioned above, and others, will be more fully appreciated from the detailed description that follows.

BRIEF DESCRIPTION OF THE DRAWINGS

FIG. 10 is a top plan view of the electrical lead terminations employed in a preferred embodiment of the invention, as viewed through the housing with the rotor removed;

FIG. 11 is a top plan view of the rotor retention casing of FIG. 7, marked for use in an eight-position binary coded rotary switch;

FIG. 12 is a top plan view, similar to that of FIG. 10, but with the stationary contact member of FIG. 3 superimposed on the lead terminations;

FIG. 13 is a table showing the combination of contact arms of the contact member that is actuated for each of the eight positions in an eight-position binary coded switch constructed in accordance with the present invention;

FIG. 14*a* is a bottom plan view of the rotor, similar to that shown in FIG. 5, but with the stationary contact member of FIG. 3 superimposed thereon, the position of the rotor relative to the contact member being that which corresponds to the numerical values of "0" or "8";

FIG. 17 is a table showing the combination of contact arms of the contact member that is actuated for each of the ten positions in a ten-position binary coded switch constructed in accordance with the present invention.

DETAILED DESCRIPTION OF A PREFERRED EMBODIMENT

Figure 7:
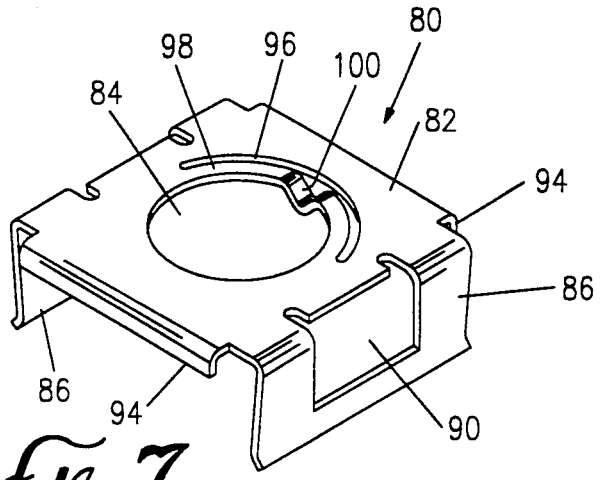
FIG. 7 is a top perspective view of a rotor retention casing of the type employed in a preferred embodiment of the invention.
Figure 8:
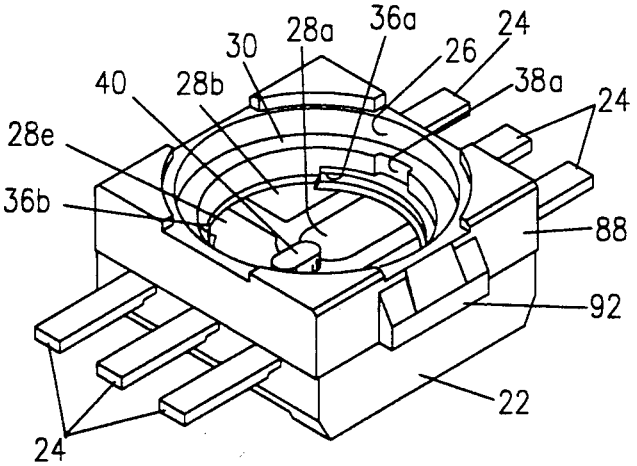
FIG. 8 is a top perspective view of a housing, with an array of electrical lead terminations disposed therein, as employed in a preferred embodiment of the invention.

Referring now to FIGS. 2 through 12, a binary coded rotary switch 20, in accordance with a preferred embodiment of the present invention, will now be described in detail. The switch 20 comprises a thermoplastic housing 22 molded onto a lead frame 24, preferably formed from silver-plated phosphorbronze. As best shown in FIG. 8, the housing 22 defines a generally circular cavity or chamber 26 that is open at the top. The lead frame 24 defines a plurality of switching terminals 28*a*, 28*b*, 28*c*, 28*d*, 28*e*(FIG. 10), arranged in a predetermined pattern (described below), that are exposed at the bottom of the chamber 26.

The chamber 26 has a stepped-in, substantially annular side wall that defines an annular shoulder 30, on which is seated an O-ring 32. A rotor 34, to be described in detail below, is disposed for rotational movement in the chamber 26, the O-ring 32 providing a seal between the rotor 34 and the housing 22. Below the shoulder 30, on the chamber side wall, are first and second diametrically-opposed arcuate lips 36*a*, 36*b*, respectively. The chamber wall above the first lip 36*a* has an axial slot 38*a*. A pair of asymmetrical axial slots 38*b* are formed in the wall above the second lip 36*b*, as best shown in FIG. 10. The asymmetry of the slots 38*b* may be achieved by spacing them differently with respect to the center of the second lip 36*b*, or by making the slots 38*b* of different sizes (arc lengths), as shown. It may be advantageous, as will be seen below, to provide a vertical post or boss 40, of a height equal to that of the tops of the lips 36*a*, 36*b*, extends upwardly from the bottom of the chamber 26, between the center of the chamber and the second lip 36*b*.

Figure 3:
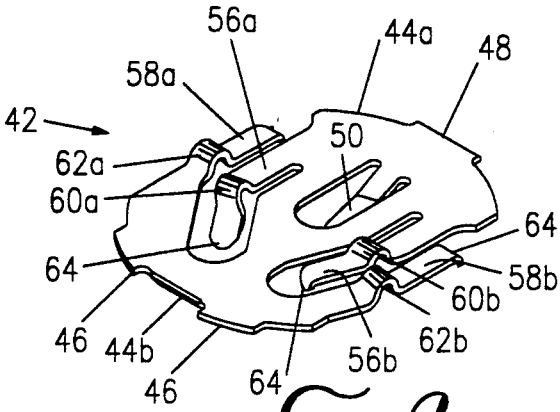
FIG. 3 is a top perspective view of a stationary contact member, of the type employed in a preferred embodiment of the invention.
Figure 1:
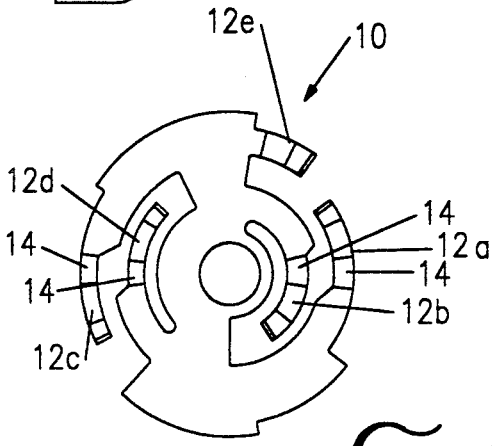
FIG. 1 PRIOR ART
FIG. 1 is a top plan view of a stationary contact member, of the type used in a prior art rotary switch.
Figure 6:
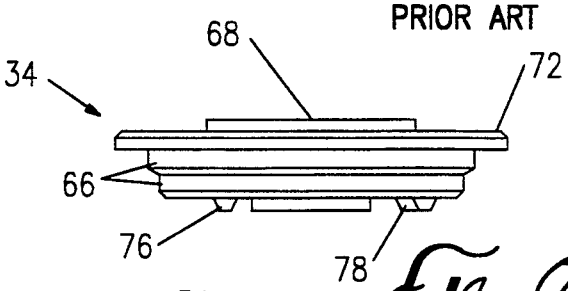
FIG. 6 is a side elevational view of the rotor of FIG. 4.
Figure 4:
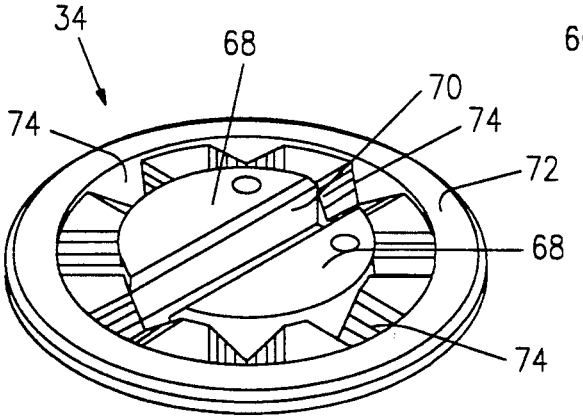
FIG. 4 is a top perspective view of a rotor of the type employed in a preferred embodiment of the invention.

As shown in FIG. 3, a stationary contact member or spider 42 (described in detail below) is fixed in the housing 22 between the rotor 34 and the lead frame terminals 28*a*–28*e*. The spider 42 has first and second diametrically-opposed end portions 44*a*, 44*b* that respectively seat on the first and second arcuate lips 36*a*, 36*b* in the chamber 26, for proper axial spacing of the spider 42 from the rotor 34 and the terminals 28*a*–28*e*. The vertical post 40 provides support for the central portion of the spider. A pair of tabs 46, extending outwardly from the second spider edge 44*b*, are received in the slots 38*b* in the wall above the second lip 36*b*, while a single tab 48 extending outwardly from the first spider edge 44*a* is received in the slot 38 above the first lip 36*a*. The engagement between the single tab 48 and the slot 38, and between the double tabs 46 and the slots 38*b*, restrains the spider 42 from rotational movement within the chamber 26. The asymmetrical spacing of the double tabs 46 with respect to the second lip 36*b* assures that the spider cannot be inadvertently installed upside-down, while the use of a single tab 48 at one edge and double tabs at the other edge assures that the spider cannot be installed backwards.

The spider 42 includes a resilient central contact finger 50 having a free end that is axially aligned with the approximate center of the spider, but angled axially out of the plane of the spider. The central contact finger 50 serves as a common or ground contact, and is maintained in electrical contact with one of the switching terminals (designated by the numeral 28*a*) that serves as a common terminal. (See FIGS. 8, 10, and 12.)

The spider 42 includes a first, or inner, pair of resilient spring contact arms 56*a*, 56*b*, and a second, or outer, pair of resilient spring contact arms 58*a*, 58*b*, arranged symmetrically with respect to the central contact finger 50. The inner contact arms 56*a*, 56*b* extend in a first direction from the first spider end portion 44*a* toward the second spider end portion 44*b*, while the outer contact arms 58*a*, 58*b* extend in a second direction from the second end portion 44*b* toward the first end portion 44*a*. A pair of inner cam follower protuberances 60*a*, 60*b* are respectively provided on the inner contact arms 56*a*, 56*b*, and a pair of outer cam follower protuberances 62*a*, 62*b* are respectively provided on the outer contact arms 58*a*, 58*b*. The inner cam followers 60*a*, 60*b* are equidistantly spaced from the center of the spider, on opposite sides thereof, at a first radial distance from the center. The outer cam followers 62*a*, 62*b* are equidistantly spaced from the center of the spider, on opposite sides thereof, at a second radial distance from the center greater than the first radial distance. Thus, at each of the first and second radial distances, there are two cam followers.

Each of the contact arms 56*a*, 56*b*, 58*a*, 58*b* has a downturned free end or contact 64 that establishes electrical contact with a corresponding switching terminal when the contact arm is actuated in the manner described below.

As illustrated in FIGS. 2, 4, 5, and 6, the rotor 34 is a generally disc-shaped element of insulating material, such as a thermoplastic, having a stepped side wall 66 that creates a sealing engagement with the O-ring 32, while allowing the rotor to be rotated with respect to the housing 22. The axis of rotation of the rotor 34 is at least approximately coincident with the geometric center of the spider 42. The top or external surface of the rotor has a central area 68 that is divided into two substantially semicircular portions by a diametric slot 70, dimensioned and located to receive a tool (not shown) for rotating the rotor 34. Forming the periphery of the rotor's external surface is an annular peripheral flange 72 that seats against an adjacent surface of the O-ring 32. Extending between the central area 68 and the flange 72 are a plurality of radial detent grooves 74.

Figure 5:
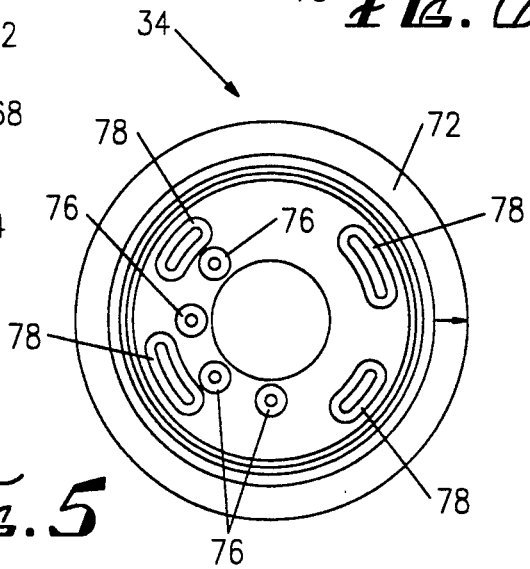
FIG. 5 is a bottom plan view of the rotor of FIG. 4, as configured in an eight-position binary coded rotary switch.

The bottom or interior surface of the rotor 34 (FIGS. 5 and 6) is provided with a first plurality of axially-extending inner camming elements 76, and a second plurality of axially-extending outer camming elements 78. The inner camming elements 76, which are substantially conical in shape, are located at a first radial distance from the center of the rotor 34 that is equal to the first radial distance separating the inner cam followers 60*a*, 60*b* from the center of the spider 42. They thus are located so as to operatively engage the inner cam followers. The outer camming elements 78, which resemble axially-tapered arcuate ridges, are located at a second radial distance from the center of the rotor 34 that is equal to the second radial distance separating the outer cam followers 62*a*, 62*b* from the center of the spider. They are thus located so as to operatively engage the outer cam followers. Thus, by definition, the distance separating the inner camming elements 76 from the outer camming elements 78 is equal to the distance separating the inner cam followers 60*a*, 60*b* from the outer cam followers 62*a*, 62*b*. As will be discussed in detail below, the arrangement of the camming elements 76, 78 shown in FIG. 5 is for an eight-position rotary switch.

Figure 2:
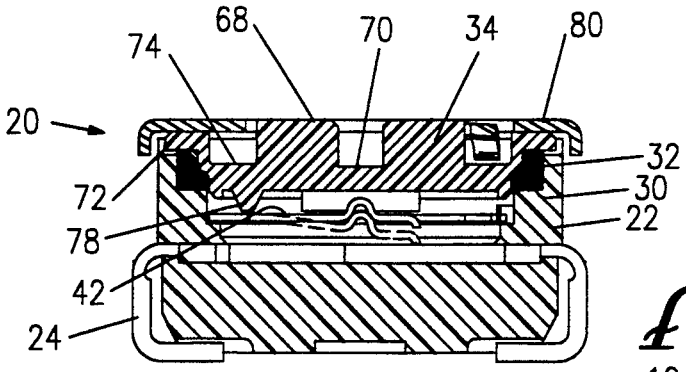
FIG. 2 is a cross-sectional view of a rotary switch in accordance with a preferred embodiment of the invention.
Figure 9:
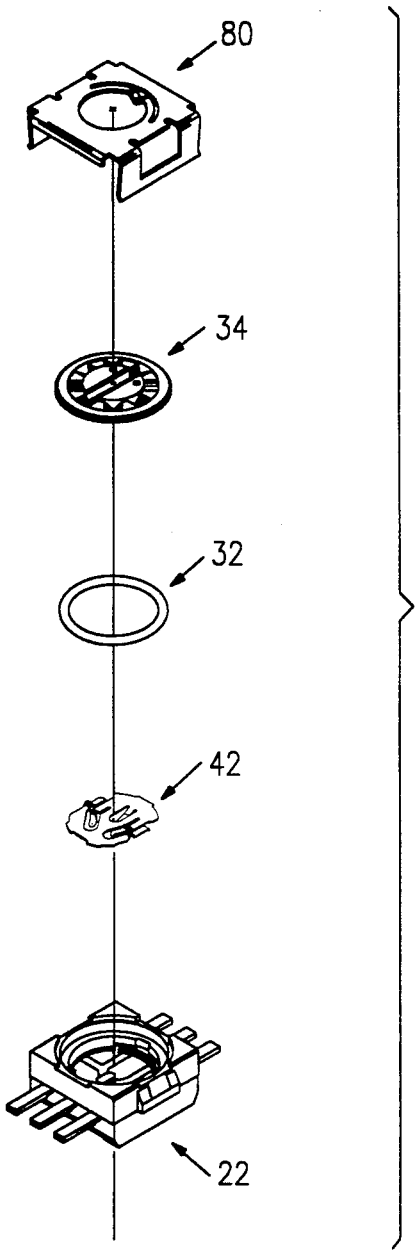
FIG. 9 is an exploded perspective view of a rotary switch in accordance with a preferred embodiment of the invention.

As shown in FIGS. 2, 7, and 9, the rotor 34 is retained in place by a casing 80, which may be formed of a metal stamping. As best shown in FIG. 7, the casing has a substantially planar upper portion 82 with a central aperture 84, through which the central area 68 of the rotor 34 is exposed. The upper portion 82 engages the peripheral flange 72 of the rotor, seating the latter against the O-ring 32, as shown in FIG. 2. A pair of side portions 86 depend downwardly from two opposed sides of the upper portion 82, so as to engage two opposed side walls 88 of the housing 22. Each of the side portions 86 has a straight-edged aperture or window 90. The corresponding side walls 88 of the housing are each provided with an integral locking projection 92 that extends outwardly therefrom, so as to register with the corresponding window 90, thereby providing a locking engagement between the housing 22 and the casing 80. The side edges of the casing 80 from which the side portions 86 do not depend are advantageously formed with a down-turned lip 94 that engages the adjacent housing surface for a more secure grip between the casing 80 and the housing 22.

The upper portion 82 of the casing 80 is provided with an arcuate slit 96, adjacent to, and concentric with, the central aperture 84. An arcuate strip 98, narrow enough to flex resiliently, is thereby formed between the slit 96 and the central aperture 84. At the approximate center of the strip 98 a downwardly-extending detent projection 100 is formed. The detent projection 100 resiliently engages the detent grooves 74 in the top of the rotor 34, to provide a plurality of detented positions, and to provide a tactile indication of rotor rotation. FIG. 11 illustrates a casing 80, in which the top portion 82 is marked to indicate eight binary-coded positions (0–7).

FIG. 10 illustrates the layout, within the housing 22, of the switching terminals 28*a*, 28*b*, 28*c*, 28*d*, and 28*e* for either an eight-position or a ten-position rotary switch. The switching terminal 28*a* terminates a common or ground lead 102*a*, and it corresponds to a binary-coded value of "0". The other switching terminals 28*b*, 28*c*, 28*d*, and 28*e* terminate output leads 102*b*, 102*c*, 102*d*, and 102*e*, respectively, and they correspond to binary-coded output values of "1", "2", "4", and "8", respectively. (The switching terminal 28*e* and its associated lead 102*e*, corresponding to the output value of "8", are not employed in an eight-position switch, although these components may physically be present.) The output leads 102*a*–102*e* may be trimmed and bent under the housing 22, as shown in FIG. 2, to provide a surface-mount configuration.

FIG. 12 illustrates the relationship, in either an eight-position or a ten-position switch, between the contact elements of the spider 42 and the switching terminals 28*a* through 28*e* when the spider is installed in the housing as described above. Specifically, the central contact finger 50 is maintained in contact with the common switching terminal 28*a*, so that there is always a common or ground connection representing a "0" value. A first one 58*a* of the outer contact arms is disposed so as to be overlying, but normally spaced from, the switching terminal 28*b* corresponding to the output value of "1". A second one 58*b* of the outer contact arms is similarly disposed with relation to the switching terminal 28*c* corresponding to the output value of "2". Likewise, a first one 56*a* of the inner contact arms overlies, but is normally spaced from, the switching terminal 28*e* corresponding to the output value of "8", while a second one 56*b* of the inner contact arms is similarly disposed with relation to the switching terminal 28*d* corresponding to the output value of "4".

In general terms, the operation of the above-described preferred embodiment of the invention (whether an eight position or a ten-position switch) may be described as follows:

Rotation of the rotor 34 (by a suitable tool, not shown) causes the camming elements 76, 78 to engage, in a predetermined sequence dictated by their shapes and location, the cam followers 60*a*, 60*b*, 62*a*, 62*b*. The operative engagement between a camming element and a cam follower causes the contact arm on which the engaged cam follower is located to flex axially out of the plane of the spider 42, bringing its contact end 64 into electrical contact with its adjacent associated switching terminal. The closure of a contact 64 with an associated switching terminal produces an output signal indicative of the numerical value to which that switching terminal corresponds. Thus, for example, the actuation of the contact arm adjacent to the "1" switching terminal produces an output signal indicative of the numerical value of "1". Output signals indicative of the numerical values of "2", "4", and "8"are similarly produced by the actuation of the contact arms adjacent to the switching terminals respectively corresponding to these values. Output signals indicative of the values "3", "5", "6", and "7", (and "9", in a ten-position switch) are produced by the simultaneous actuation of two or more contact arms. A value of "0" is obtained when none of the movable contact arms are actuated, leaving only the central contact finger 50 in electrical contact with the common or ground terminal 28*a*.

The operation of an eight-position position switch in accordance with the above-described preferred embodiment is illustrated in FIGS. 13, 14*a*, 14*b*, and 14*c*. FIG. 13 is a table that shows the combinations of switching terminals that, when closed by a contact arm, produce output signals representing each of eight binary-coded numerical values. The switching terminals corresponding to the values of "1", "2", and "4", and the common or ground terminal ("C") are displayed horizontally, while the numerical output values 0–7 are displayed vertically. An "X" indicates a closed terminal. It is seen that the common terminal is always closed, for all output values, and only the common terminal is closed for the output value of "0". For the other output values of "1" through "7", one or more of the "1", "2", and "4" terminals are closed, in addition to the common terminal. The "8" terminal is never closed, since its associated contact arm remains unactuated in an eight-position switch, in which only output signal values of "1" through "7" are used.

FIG. 14*a* shows the juxtaposition between the camming elements 76, 78 and the cam followers 60*a*, 60*b*, 62*a*, 62*b* in an eight-position switch when the rotor is rotated to a position to output a "0" value. As shown, none of the cam followers 60*a*, 60*b*, 62*a*, 62*b*is engaged by any of the camming elements 76, 78, leaving all of the contact arms 56*a*, 56*b*, 58*a*, 58*b*unactuated, and all of the switching terminals 28*b*–28*e* open.

Figure 14B:
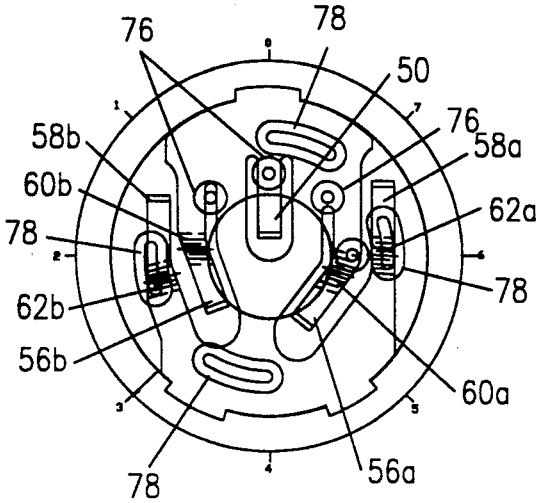
FIG. 14*b* is a view similar to that of FIG. 14*a*, but with the rotor rotated to a position that corresponds to the numerical value of "3"

In FIG. 14*b*, the rotor 34 has been rotated to a position to output a value of "3". In this position, the cam follower 62*a* on the outer contact arm 58*a*, corresponding to the output value of "1", is operatively engaged by one of the outer camming elements, so that the switching terminal 28*b* is closed to produce an output signal indicative of the value "1". Likewise, the cam follower 62*b* on the other outer contact arm 58*b* is operatively engaged by another of the outer camming elements 78 to close the switching terminal 28*c*, thereby producing an output signal indicative of the value "2". The algebraic sum of the two output signals is indicative of the value "3". Neither of the cam followers 60*a*, 60*b* on the inner contact arms 56*a*, 56*b* is engaged by any of the inner camming elements 76, thereby leaving open the switching terminals 28*d* (representing the output value "4") and 28*e* (representing the output value "8").

Figure 14C:
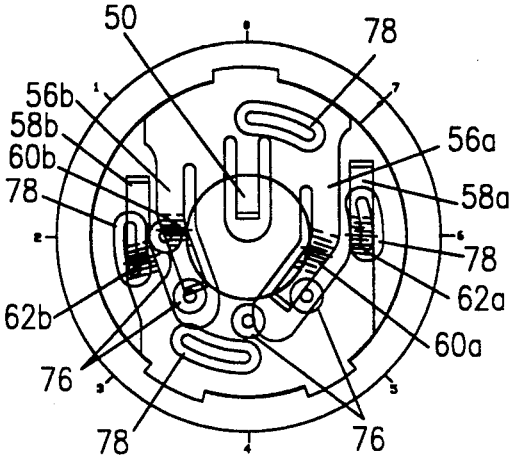
FIG. 14*c* is a view similar to that of FIGS. 14*a* and 14*b*, but with the rotor rotated to a position that corresponds to the numerical value of "7"

FIG. 14*c* shows the rotor 34 rotated to a position to output the value of "7". In this position, the cam followers 62*a* and 62*b* on both of the outer contact arms 58*a* and 58*b* are operatively engaged by outer camming elements 78, thereby closing the switching terminals 28*b* and 28*c*, representing the numerical output values of "1" and "2", respectively. The cam follower 60*b* on the one of the inner contact arms 56*b* adjacent the "4" value switching terminal 28*d* is operatively engaged by one of the inner camming elements 76, thereby closing the switching terminal 28*d* to yield an output signal value of "4". The algebraic sum of the output signal values of "1", "2", and "4" is "7". The cam follower 60*a* on the other one 56*a* of the inner contact arms remains unengaged by any of the inner camming elements 76, thereby leaving open the switching terminal 28*e*, representing the output signal indicative of the numerical value of "8".

Figure 15:
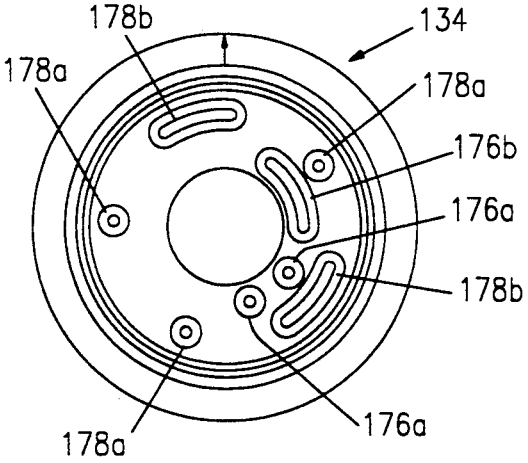
FIG. 15 is a bottom plan view of a rotor as configured for use in a ten-position binary coded switch.
Figure 16:
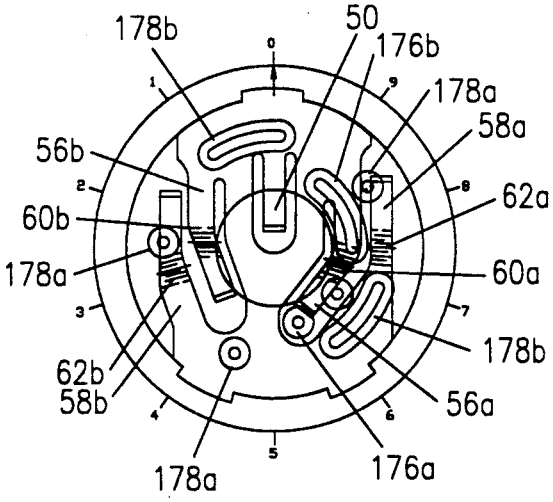
FIG. 16 is a bottom plan view of the rotor of FIG. 15, but showing the stationary contact member of FIG. 3 superimposed thereon, the position of the rotor relative to the contact member being that which corresponds to the numerical values of "0" or "10"

FIGS. 15 and 16 illustrate a rotor 134 configured for use in a ten-position rotary switch. The rotor 134 includes a first plurality of axially-extending inner camming elements 176*a*, 176*b*, and a second plurality of axially-extending outer camming elements 178*a*, 178*b*. In the illustrated embodiment, there are two substantially conical inner camming elements 176*a*, and one inner camming element 176*b* resembling an axially-tapered arcuate ridge. The outer camming elements include three substantially conical elements 178*a* and two elements 178*b* having the above-described arcuate ridge configuration.

In the ten-position switch, the rotor 134 may be employed with the same spider 42 as is used in the eight-position switch, as described above, but with the inner contact arm 56*a* associated with the "8" value switching terminal 28*e* being used, as described below. As in the eight-position switch, the inner camming elements 176*a*, 176*b* are spaced from the rotor center by a first radial distance equal to the first radial distance between the center of the spider 42 and the inner cam followers 60*a*, 60*b*, and the outer camming elements 178*a*, 178*b* are spaced from the center of the rotor by a second radial distance equal to the second radial distance between the spider center and the outer cam followers 62*a*, 62*b*. Thus, as the rotor is turned, the inner camming elements 176*a*, 176*b* operatively engage the inner cam followers 60*a*, 60*b* in a predetermined sequence, while the outer camming elements 178*a*, 178*b* do likewise with the outer cam followers 62*a*, 62*b*, as shown in FIG. 16.

The additional camming elements of the ten-position switch, (as compared to the eight-position switch), are needed to provide the two additional output signal values of "8" and "9" both of which require the closure of the switching terminal 28*e*, corresponding to the output signal value of "8". The closure of the "8" value switching terminal 28*e* is accomplished by the actuation of the inner contact arm 56*a* through the operative engagement of the inner camming elements 176*a*, 176*b* against that arm's cam follower 60*a* in the predetermined sequence dictated by the location and configuration of the inner camming elements 176*a*, 176*b*.

Like the previously-described eight-position switch, the ten-position switch produces output signals indicative of the integral numerical values of "0" to "9", by actuating contact arms to close against their associated switching terminals. This closure is achieved through the engagement of the camming elements 176*a*, 176*b*, 178*a*, 178*b* with the cam followers 60*a*, 60*b*, 62*a*, 62*b* in the predetermined sequence dictated by the shape and location of the camming elements with respect to the cam followers. The combinations of switching terminals that, when closed by a contact arm, produce output signals representing each of ten binary-coded numerical values are tabulated in the table of FIG. 17 (the format of which is similar to the above-described table of FIG. 13). From FIG. 17, it can be seen that in the ten-position switch, as in the previously-described eight-position switch, the common terminal is always closed, for all output values, and only the common terminal is closed for the output value of "0". For the values of "1", "2", "4", and "8", only a single switching terminal (in addition to the coramon terminal), corresponding to the selected one of those values, is closed. For the remaining values of "3", "5", "6", "7", and "9", combinations of two or three terminals (in addition to the common terminal) are simultaneously closed, whereby the algebraic sum of the output signals yields the selected value.

From the foregoing description, it will be appreciated that, by using an arrangement of contact arms, camming elements, and switching terminals that allows more than one contact arm to be actuated at a given radial distance from the center of the device (that is, by camming elements sharing a common radius), optimum usage of space is achieved. As a result, higher degrees of miniaturization can be attained than has heretofore been thought practical, without sacrificing durability or reliability.

Moreover, the asymmetrical tab and slot arrangement for fixing the spider in the chamber facilitates the assembly of the ultra-miniaturized components constructed in accordance with the present invention, by substantially preventing the inadvertent erroneous orientation of the spider in the chamber.

Although rotary switches with eight and ten binary-coded output values have been described herein as exemplary embodiments of the present invention, it will be appreciated by those skilled in the pertinent arts that the principles of the invention can be applied to switches having larger numbers of output values, with relatively minor modifications that will readily suggest themselves to such skilled practitioners. Such modifications, and others that may suggest themselves, are considered within the spirit and scope of the present invention, as defined in the claims that follow.

What is claimed is:

1. A rotary switch, comprising:

a housing defining a chamber having an open upper end;

a plurality of switching terminals fixed in the housing so as to be exposed in the chamber;

a substantially planar contact member fixed in the chamber adjacent to the switching terminals, the contact member having a central common contact finger in electrical contact with one of the switching terminals, and a plurality of spring contact arms spaced from each other so as to be individually movable axially out of the plane of the contact member into electrical contact with one of the switching terminals;

a cam follower element on each of the contact arms, at least two of the contact arms having respective cam follower elements that are equidistantly spaced, by a first distance, from the center of the contact member;

a rotor rotatably mounted in the chamber and having a top surface and a bottom surface, the rotor having an axis of rotation that is at least approximately coincident with the center of the contact member; and a plurality of camming elements extending axially from the bottom surface of the rotor so as to be operatively engageable against the cam follower elements in a predetermined sequence as the rotor is rotated in the chamber, at least one of the camming elements being located a radial distance from the axis of rotation that is equal to the first distance;

whereby the operative engagement between a camming element and a cam follower element moves the contact arm on which the engaged cam follower element is disposed axially into electrical contact with one of the switching terminals.

2. The rotary switch of claim 1, wherein the equidistant cam follower elements are on diametrically opposite sides of the center of the contact member.

3. The rotary switch of claim 1, wherein the top surface of the rotor includes a plurality of radial detent grooves, and wherein the switch further comprises:

rotor retention means, secured to the housing so as to retain the rotor in the chamber, and including a circular aperture through which a substantial portion of the top surface of the rotor is exposed; and detent means, on the rotor retention means, for engagement in each of the detent grooves sequentially as the rotor is rotated.

4. The rotary switch of claim 1, wherein each of the contact arms represents a unique binary bit, and wherein each of the switching terminals is associated with a unique one of the contact arms, whereby the making of electrical contact between each contact arm and its associated switching terminal yields an output signal indicative of the binary bit represented by that contact arm.

5. The rotary switch of claim 4, wherein the contact member comprises:

a first pair of contact arms, each having a cam follower element located the first distance from the center of the contact member; and a second pair of contact arms, each having a cam follower element located a second radial distance from the center of the contact member, the second distance being greater than the first distance.

6. The rotary switch of claim 5, wherein the contact member has first and second diametrically-opposed end portions, and wherein the first pair of contact arms extend from the first end portion toward the second end portion, and the second pair of contact arms extend from the second end portion toward the first end portion.

7. The rotary switch of claim 5, wherein the plurality of camming elements is a first plurality of camming elements that are operatively engageable against the cam follower elements on the first pair of contact arms, the rotary switch further comprising:

a second plurality of camming elements extending axially from the bottom surface of the rotor so as to be operatively engageable against the cam follower elements on the second pair of contact arms.

8. The rotary switch of claim 7, wherein the plurality of switching terminals comprises:

a first switching terminal disposed to be contacted by a first one of the first pair of contact arms when the cam follower element on the first one of the first pair of contact arms is operatively engaged by a camming element, and that produces a first output signal value when so contacted;

a second switching terminal disposed to be contacted by a first one of the second pair of contact arms when the cam follower element on the first one of the second pair of contact arms is operatively engaged by a camming element, and that produces a second output signal value when so contacted;

a third switching terminal disposed to be contacted by a second one of the second pair of contact arms when the cam follower element on the second one of the second pair of contact arms is operatively engaged by a camming element, and that produces a third output signal value when so contacted; and a common switching terminal disposed to be contacted by the common contact finger.

9. The rotary switch of claim 8, further comprising:

a fourth switching terminal disposed to be contacted by a second one of the first pair of contact arms when the cam follower element on the second one of the first pair of contact arms is operatively engaged by a camming element, and that produces a fourth output signal value when so contacted.

10. The rotary switch of claim 6, wherein the chamber is defined by a substantially annular wall surface, and wherein the switch further comprises:

contact member retention means, cooperatively engageable between the contact member and the wall surface, for restraining the contact member from rotation, and for allowing only a single orientation of the contact member in the chamber.

11. The rotary switch of claim 10, wherein the contact member retention means comprises:

a first tab extending from the first end portion of the contact member;

a pair of asymmetric second tabs extending from the second end portion of the contact member;

first tab receiving means in the wall surface for receiving the first tab; and second tab receiving means in the wall surface for receiving the second tabs.

12. A rotary switch, comprising:

a housing defining a chamber having an open upper end;

a plurality of switching terminals fixed in the housing so as to be exposed in the chamber;

a substantially planar contact member fixed in the chamber adjacent to the switching terminals, the contact member having a center, and a first end portion and a second end portion on opposite sides of the center;

a central common contact finger extending from the contact member and having an end axially spaced from the approximate center thereof, the contact finger being in electrical contact with one of the switching terminals;

a first pair of spring contact arms extending from the first end portion of the contact member toward the second end portion thereof, each of the first pair of contact arms being individually movable axially out of the plane of the contact member into electrical contact with an associated one of a first pair of the switching terminals;

a second pair of spring contact arms extending from the second end portion of the contact member toward the first end portion thereof, each of the second pair of contact arms being individually movable axially out of the plane of the contact member into electrical contact with an associated one of a second pair of the switching terminals;

a cam follower element on each of the contact arms, at least one of the first and second pairs of the contact arms having respective cam follower elements that are equidistantly spaced, by a first distance, from the center of the contact member;

a rotor rotatably mounted in the chamber and having a top surface and a bottom surface, the rotor having an axis of rotation that is at least approximately coincident with the center of the contact member; and a plurality of camming elements extending axially from the bottom surface of the rotor so as to be operatively engageable against the cam follower elements in a predetermined sequence as the rotor is rotated in the chamber, at least one of the camming elements being located a radial distance from the axis of rotation that is equal to the first distance;

whereby the operative engagement between a camming element and a cam follower element moves the contact arm on which the engaged cam follower element is disposed axially into electrical contact with its associated one of the switching terminals.

13. The rotary switch of claim 12, wherein each of the first pair of contact arms, and each of the second pair of contact arms, are on opposite sides of the center of the contact member.

14. The rotary switch of claim 13, wherein the cam follower elements on the first pair of contact arms are equidistantly spaced from the center of the contact member by the first distance, and wherein the cam follower elements on the second pair of contact arms are equidistantly spaced from the center of the contact member by a second distance that is greater than the first distance.

15. The rotary switch of claim 12, wherein the top surface of the rotor includes a plurality of radial detent grooves, and wherein the switch further comprises:

rotor retention means, secured to the housing so as to retain the rotor in the chamber, and including a circular aperture through which a substantial portion of the top surface of the rotor is exposed; and detent means on the rotor retention means, for engagement in each of the detent grooves sequentially as the rotor is rotated.

16. The rotary switch of claim 12, wherein each of the contact arms represents a unique binary bit, and wherein each of the switching terminals is associated with a unique one of the contact arms, whereby the making of electrical contact between each contact arm and its associated switching terminal yields an output signal indicative of the binary bit represented by that contact arm.

17. The rotary switch of claim 12, wherein the plurality of camming elements is a first plurality of camming elements that are operatively engageable against the cam follower elements on the first pair of contact arms, the rotary switch further comprising:

a second plurality of camming elements extending axially from the bottom surface of the rotor so as to be operatively engageable against the cam follower elements on the second pair of contact arms.

18. The rotary switch of claim 12, wherein the plurality of switching terminals comprises:

a first switching terminal disposed to be contacted by a first one of the first pair of contact arms when the cam follower element on the first one of the first pair of contact arms is operatively engaged by a camming element, and that produces a first output signal value when so contacted;

a second switching terminal disposed to be contacted by a first one of the second pair of contact arms when the cam follower element on the first one of the second pair of contact arms is operatively engaged by a camming element, and that produces a second output signal value when so contacted;

a third switching terminal disposed to be contacted by a second one of the second pair of contact arms when the cam follower element on the second one of the second pair of contact arms is operatively engaged by a camming element, and that produces a third output signal value when so contacted; and a common switching terminal disposed to be contacted by the common contact finger.

19. The rotary switch of claim 18, wherein the plurality of switching terminals further comprises:

a fourth switching terminal disposed to be contacted by a second one of the first pair of contact arms when the cam follower element on the second one of the first pair of contact arms is operatively engaged by a camming element, and that produces a fourth output signal value when so contacted.

20. The rotary switch of claim 12, wherein the chamber is defined by a substantially annular wall surface, and wherein the switch further comprises:

contact member retention means, cooperatively engageable between the contact member and the wall surface, for restraining the contact member from rotation, and for allowing only a single orientation of the contact member in the chamber.

21. The rotary switch of claim 20, wherein the contact member retention means comprises:

a first tab extending from the first end portion of the contact member;

a pair of asymmetric second tabs extending from the second end portion of the contact member;

first tab receiving means in the wall surface for receiving the first tab; and second tab receiving means in the wall surface for receiving the second tabs.

* * * * *